US005540008A

United States Patent [19]

Kirnstätter

[11] Patent Number: 5,540,008

[45] Date of Patent: Jul. 30, 1996

[54] SYSTEM BEARING ON A SMALL ARM

[76] Inventor: Karl-Günter Kirnstätter, Im Weiher 6, D-78664 Echbronn, Germany

[21] Appl. No.: 333,785

[22] Filed: Nov. 3, 1994

[30] Foreign Application Priority Data

Nov. 3, 1993 [DE] Germany ..... 43 37 495.6

[51] Int. Cl.[6] ..... F41A 21/48

[52] U.S. Cl. ..... 42/75.02

[58] Field of Search ..... 42/75.01, 75.02, 42/75.03

[56] References Cited

U.S. PATENT DOCUMENTS

| | | | |
|---|---|---|---|
| 1,348,702 | 8/1920 | Gabbett-Faixfax | 42/75.02 |
| 2,353,118 | 7/1944 | Schirokauer | 42/75.02 |
| 3,731,418 | 5/1973 | Birkenhagen et al. | 42/75.02 |
| 4,388,773 | 6/1983 | Beretta | 42/75.02 |

FOREIGN PATENT DOCUMENTS

| | | | |
|---|---|---|---|
| 94083 | 6/1969 | France | 42/75.02 |
| 3522027 | 4/1968 | Germany . | |
| 1959748 | 10/1972 | Germany . | |
| 2911999 | 10/1979 | Germany . | |
| 2057995 | 1/1980 | Germany . | |

*Primary Examiner*—Stephen C. Bentley
*Attorney, Agent, or Firm*—Palmatier, Sjoquist & Helget P.A.

[57] ABSTRACT

An improved system bearing on a firearm is proposed in which the barrel is clamped by means of a wedge-locking mechanism in the barrel bed of a receiver developed at the breech of the firearm. The wedge-locking mechanism can exhibit a tension wedge or a locking mechanism via normal inclined running wedge surfaces. The system bearing block is structured such that the barrel locking mechanism can make available an additional supplemental lock.

8 Claims, 5 Drawing Sheets

SYSTEM BEARING ON A SMALL ARM

BACKGROUND OF THE INVENTION

The invention concerns an improved system bearing on a small arm with a mounting mechanism for a barrel in a barrel receiver which functions together with a breech bolt.

There are known guns by which the barrel can be exchanged for the firing of different calibers. With such weapons, usually the barrel, locking assembly and the trigger assembly, together with the system bearing block, comprise a system capable of firing.

In one known design, the barrel is exchangeable by loosening a dual screw fitting. The one screw fitting engages into the sight foot, the other screw fitting into the locking assembly into which the cartridge bearing of the barrel is inserted. By this manner of anchoring, a more or less complete stripping of the gun is necessary, such that a change of barrel for this known gun makes large scale disassembly and assembly necessary.

Thus, the task underlying the invention is to submit a system which enables changing from one caliber group to another using simple and economical construction.

The task is solved according to invention in that the barrel is clamped in the barrel bed of the barrel receiver by means of a wedge-locking mechanism. This wedge-locking mechanism can be released or tightened without disassembly of further components such that a simple and expeditious exchange is guaranteed. A specific design form consists of the wedge-locking mechanism being an eccentrically functioning tension bolt arrangement designed between the barrel and barrel receiver.

The bolt can be eccentrically designed with advantage.

This tension bolt is twistable and is received in a bore hole running transverse to the direction of the barrel, which bore hole is formed partly on the external circumference of the barrel and partly in the barrel bed of the barrel receiver. The wedging is applied by a simple twisting of the bolt whereby an essential force component is directed against the back stopping face of the barrel bed.

It is additionally advantageous that the bolt centers lie in the barrel receiver. Through this measure, it is achieved that the effective force on the barrel can be supported on the barrel receiver.

In this, it is preferred that the centers lie in a common plane Z.

The diameter of the borings for the tension bolt can be advantageously of different sizes, whereby the diameter in the barrel can be selected larger than the diameter of the bore hole in the barrel bed. One achieves an especially good eccentric effect by this.

A flat on the tension bolt is advantageously designed by which, with twisting the bolt, an eccentric-like effect is applied to the barrel.

The advantage of this is that for a gun with a system bearing block the tension bolt is secured by means of a holding screw which is passed through the system bearing block and is thus reachable. The holding screw presses advantageously onto the flat of the tension bolt by this.

It is especially advantageous if the depth H of the stopping face is greater than that of the tension height of the boring in the barrel.

The barrel receiver exhibits an inset projection in the region of the tension bolt assembly, which is inserted into an inset recess furnished in the system bearing block and secured by means of a screw.

The system bearing block advantageously exhibits essentially a T-form in longitudinal section, whereby are arranged: In the perpendicular bar, the receiver for the magazine; the wedge-locking mechanism for the barrel in the front part of the bar; and, in the rear part of the transverse bar, the trigger mechanism. The advantage of this is that the section of the bore hold formed in the barrel is part of a cylindrical boring and the section formed in the barrel bed is likewise part of a cylindrical boring whose midpoint in reference to the midpoint of the bore hole, partially in the barrel, is displaced by a specific amount toward the back in the direction of the breech. In this manner, a twisting of the tension bolt leads to a displacement of the barrel, or to a force effect on the barrel, respectively, in the direction of the stopping face in the barrel bed.

In an advantageous design it is provided that a stopping face is arranged on the tension bolt. As the holding screw is advantageously guided through the system bearing block and also through the stock, external access is possible without difficulty.

The holding screw presses against the stopping face of the tension bolt in an advantageous manner.

In an alternative design, it is intended that transverse to the lengthwise direction of the barrel is at least one, in cross section essentially rectangular recess formed in part in the barrel, in part in the barrel receiver, for receiving at least one correspondingly formed wedge.

With this, the recess in the barrel indicates a further distance from the end stopping face in the barrel bed than the recess in the receiver. Through this measure it is ensured that, with an inserted wedge in functional position, the barrel is pressed against the stopping face.

The advantage of this is that at least a single wedge is tightenable, such that the tight position of the wedge can be fixed. As a consequence of such measures, a releasing of the wedge is not to be feared even with a multiple shots.

As a tightening mechanism, it can advantageously be provided that a screw, directly or indirectly supported by the barrel receiver, is arranged on the tapered end of the wedge. This screw assembly, for example, consists of a screw which is screwed into a threaded hole, brought into the small face of the wedge in the longitudinal direction, whereby the head of the screw or an interposing washer shim is supported by the barrel receiver wall.

It is especially advantageous for reasons of symmetry if two directionally opposed wedges are provided. These wedges can be insert either in a common recess with corresponding wedge surfaces directly abutting, or they can, however, also lie respectively in a separate recess.

With the next design form, a second locking mechanism, placed at a distance from the wedge-locking mechanism, can be provided as a supplemental locking mechanism which tightens the barrel/receiver unit with reference to the system bearing block. Through this, additional security is given so that a reliable barrel seating is guaranteed which also leads to, with the greatest forces which occur, for example, during the shooting of magnum ammunition, a constant shooting performance under this shooting load.

The supplemental locking mechanism advantageously consists of a pressure screw that is screwed into a threaded hole in the system bearing block, and, leading through a bore hole in the receiver, presses against the barrel. For this, it is advantageous to make, on the barrel, a recess having a pressure surface for the pressure screw.

With the use of a system bearing block it is advantageous to provide a chamber for the holding bolt of a magazine. Advantageously, the holding bolt is arranged on the side of the magazine lying opposite the trigger guard, by which it engages the face of the magazine. The holding bolt can be advantageously furnished with a spring-loaded holding pin which exhibits a face side catch which combines with a corresponding notch in the magazine.

What is advantageous with this is that at least one inclined running ramp is provided in the transverse direction on the holding bolt which works together with a corresponding spring-loaded actuation button exhibiting a corresponding ramp for the purpose of forward and backward movement of the holding bolt. By this type of an arrangement of the holding bolt on the face side of the magazine, a positive motion sequence during exchange of the magazine can be achieved. During actuation of the holding bolt, the half-opened hand is located beneath the magazine while simultaneously the thumb and index finger can release it through pressing together by means of the actuation button. At release, the magazine falls into the opened hand such that no repeated grasping about is necessary.

The firing of different ammunition can make it necessary that the firing pin path be varied. For this, it is advantageous that in coordination with corresponding exchange barrels, different firing pin nut designs are provided whose pressure surface in the longitudinal direction are arranged at respectively different positions. Special design of these firing pin nuts, can be provide that the pressure surface is adjustably held. This movability, in the simplest case, can be the end surface of an adjusting screw. In a special design, however, it can be planned that the pressure surface is formed on an adjustable sliding pressure block which is movably held on the firing pin nut.

In the following, the invention will be clarified more exactly using the design examples depicted in the drawings. Shown are:

FIG. 1 is a view of part of a longitudinal section through a firearm at the height of the barrel anchoring;

FIG. 1*a* is a view of Detail 1 in FIG. 1;

Figure 1:
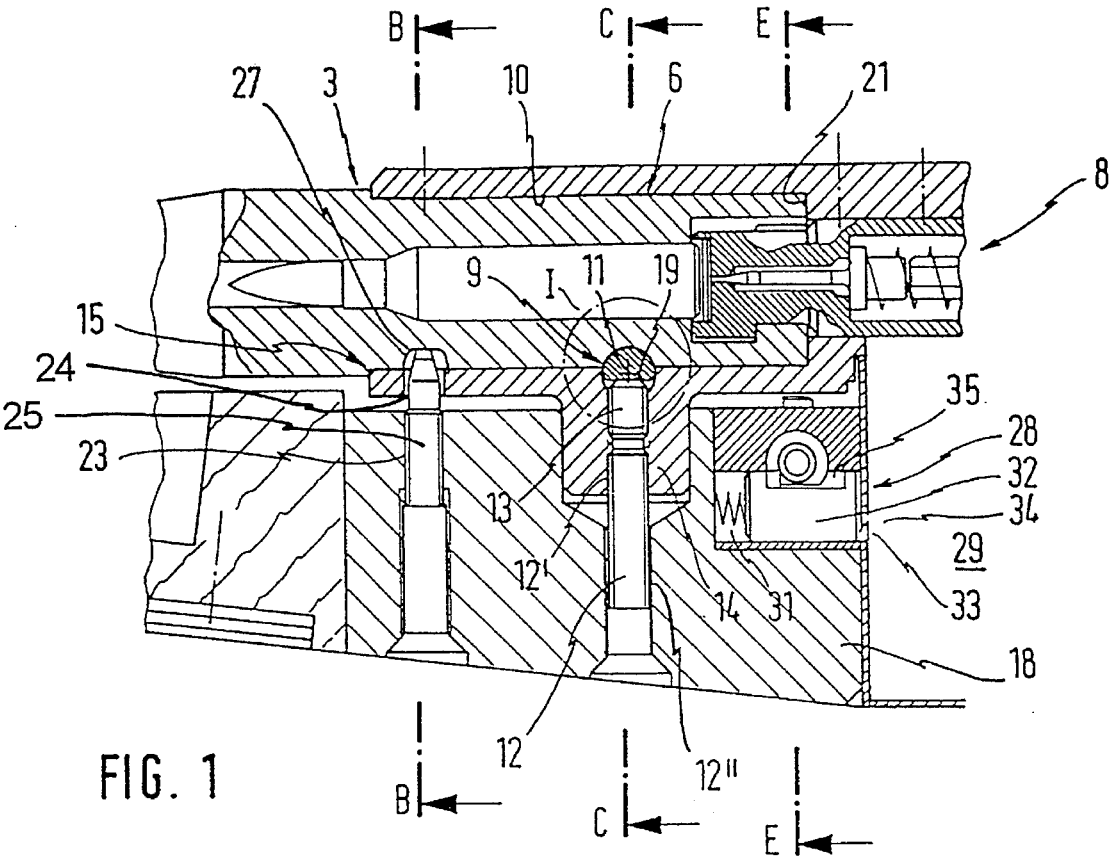

In FIG. 1 is depicted a view of a partial area of a longitudinal section through a small arm, here a rifle.

The excerpt shows the anchoring of a barrel 3 in barrel bed 10 of a receiver 6 which is part of breech bolt 8. Breech bolt 8 is assumed with the barrel receiver in a system bearing block 18.

According to invention, barrel 3 is clamped by means of a wedge-locking mechanism in barrel bed 10 of receiver 6. The wedge-locking mechanism is a designed tension bolt arrangement between barrel 3 and barrel receiver 6 in the depicted design example in FIG. 1, consisting of a tension bolt 9 which is received in a bore hole 11 running transversely to the barrel direction. The bore hole is set such that the longitudinal axis of the boring leads in the manner of a tangent to the barrel or, respectively, in the manner of a chord to a corresponding location through the barrel receiver.

The part of bore hole 11 which is formed in barrel 3 corresponds to a part of the cylinder boring, as likewise does designed part 11" in barrel bed 10, whereby the centers of the respective parts of the corresponding borings lie in the barrel receiver.

Boring part 11" in the barrel bed and thus also its corresponding midpoint 20" is displaced by a predetermined amount in reference to the bore hole part 11', and thus also in reference to the associated midpoint 20', toward the back in the direction of the breech.

Figure 1A:
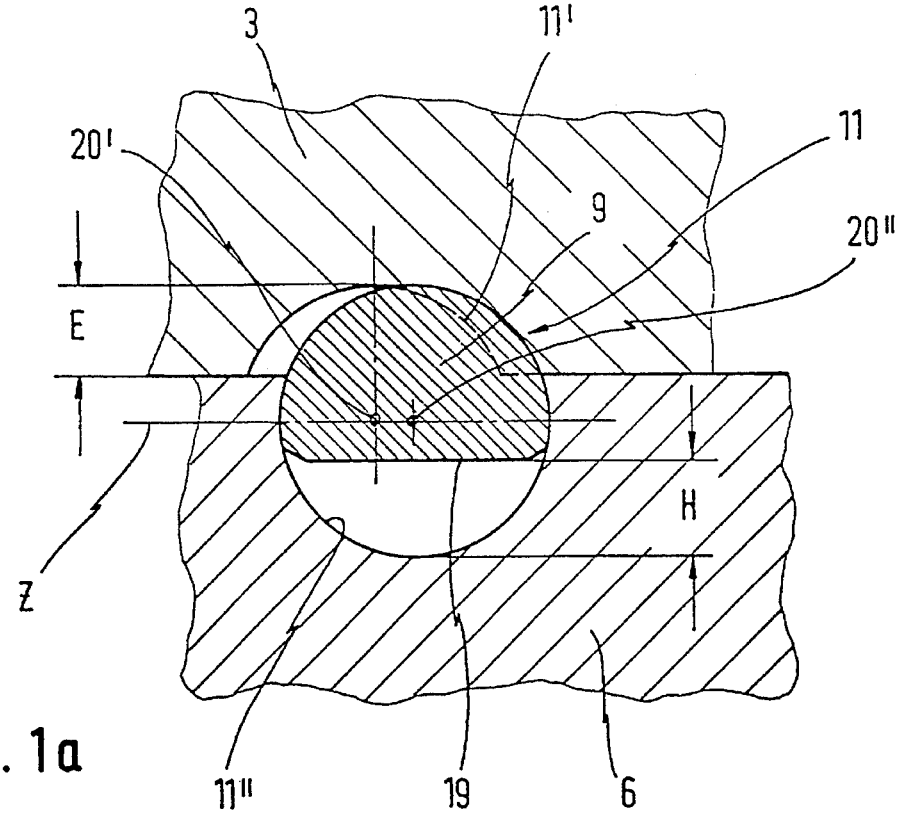
Figure 2:
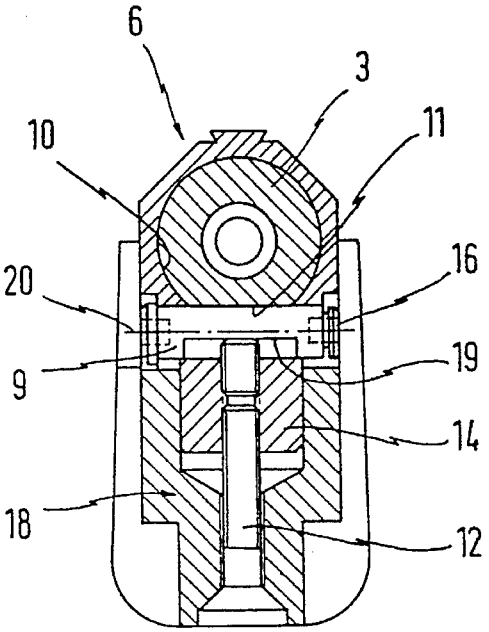
FIG. 2 is a view of a cross section along a line C—C in FIG. 1.

The tension bolt exhibits an essentially cylindrical circumferential contour in this first design example and is furnished along its entire length with a flattening 19. This flattening 19 can transition, rounded or with a phase, into the cylindrical circumference. Centers 20', 20" lie in a common plane Z in the barrel receiver (cf. FIG. 1*a*, 2).

The diameters of partial boring 11', 11" can possess, instead of the same, a different dimension from one another. Hence, the diameter of partial boring 11' in barrel bed 3 can be larger than the diameter of partial boring 11" in the barrel bed. The advantage of this strategy consists in that during the twisting motion, the bolt is situated via its corresponding circumference completely in partial boring 11" in the barrel bed and can thereby brace off a greater circumferential area, whereas by turning it into the barrel, it deploys an increasing force effect.

The tension bolt is twistable by means of a tool, for example an Allan head wrench, which can be inserted into a correspondingly formed recess 16. The twisting of the tension bolt pulls barrel 3 into the barrel bed and presses the end of the barrel onto stopping face 21 in the barrel bed. Simultaneously, however, a force component is developed which presses the barrel against the upper circumferential wall of the barrel bed.

Figure 3:
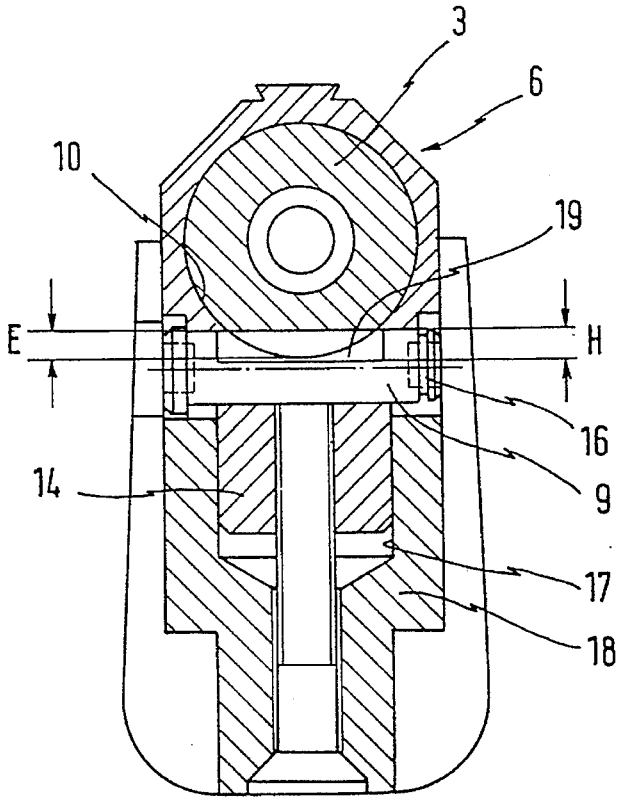
FIG. 3 is a section along the line B—B in FIG. 1.
Figure 4:
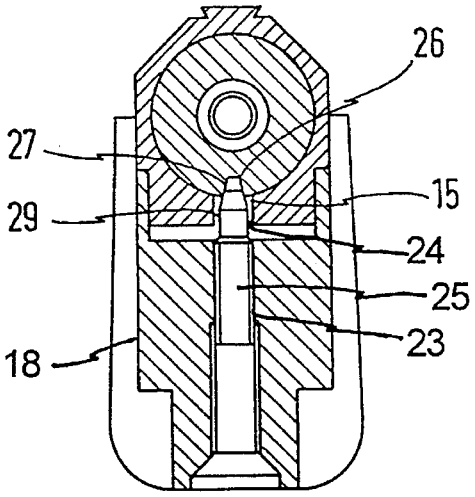
FIG. 4 is a view corresponding to FIG. 2 with a free surface of the tension bolt rotated upwards.

Further reference to FIG. 3 is made. Depicted in this is a cross section along line C—C in FIG. 1 whereby stopping face 19 of tension bolt 9 is rotated by 180° from its functional position in which it serves to secure tension bolt 9, such that it now points upward. Depth H, i.e. the distance between the stopping face or flattening 19 and the outer diameter of the tension bolt 9, is greater than the tension height E labeled height of partial boring 11', by which this boring is cut into barrel 3. This has as a consequence that barrel 3 in the position depicted in FIG. 3 can be extracted from barrel bed 10 without tension bolt 9 being a hindrance. It is self-evident in this that holding screw 13 must be loosened far enough that a 180° rotation of the tension bolt is possible.

As tension bolt 9 is accessible from the outside without difficulty, as is more closely described below, the barrel can simply and quickly be released and removed without extensive disassembly work.

In order to ensure that the barrel loosens itself during or after the triggering of one or several shots, a holding screw 13 is provided which holds tension bolt 9 in the locking position. Holding screw 13 works together with the flatting formed on the tension bolt, whereby the contact surface in reference to the tension bolt is designed such that a pressure on stopping face 19 continually results in the direction of a self-increasing clamping effect. In this, the holding screw is screwed into a thread 12' of the barrel receiver and is externally accessible as it is fed through a corresponding bore hole 12" in the system bearing block.

Barrel receiver 6 exhibits an insert projection 14 in the area of tension bolt assembly 9, 11, which is inserted into an inset recess 17 formed in system bearing block 18 whereby thread 12' for holding screw 13 is executed in inset projection 14. In this thread 12', is also screwed a system holding screw 12 which, along with other screws (not depicted), serves to fix the system bearing to the stock. In this manner, one obtains a sufficient path length in order to apply the necessary force onto stopping face 19 of tension bolt 9.

Figure 5:
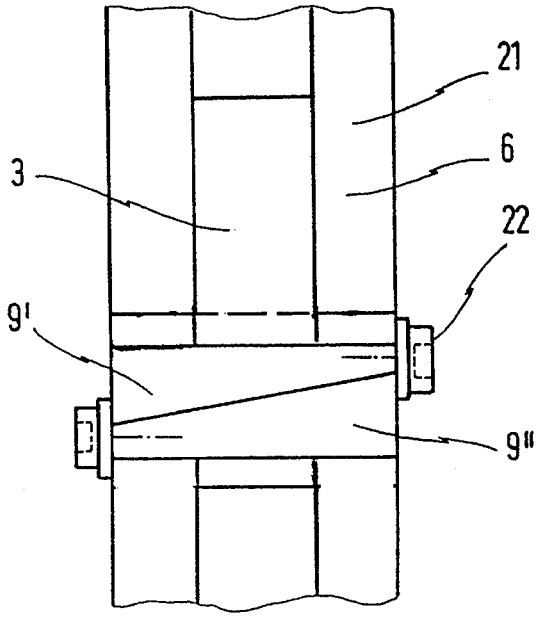
FIG. 5 is a view of a section in horizontal plane of the wedge lock of a design variant.
Figure 6:
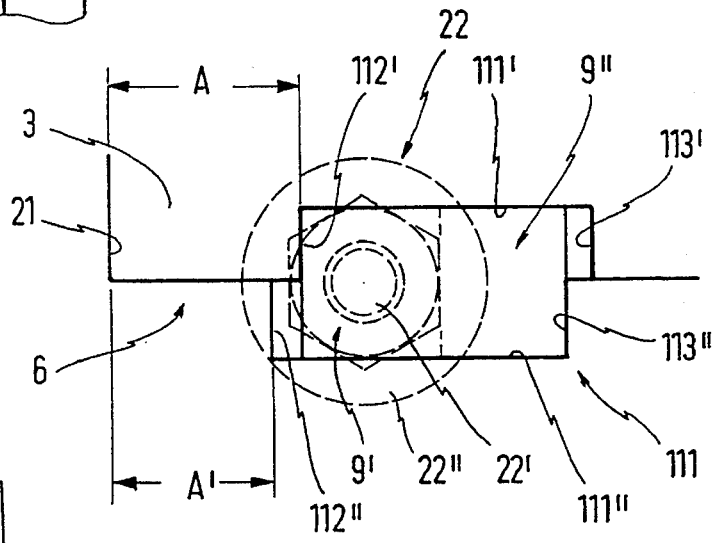
FIG. 6 is a side view on this variant with wedge lock.

FIGS. 5 and 6 are now referred to. In this is depicted a design variant of a wedge-locking mechanism. Also in this design form is a recess 111 formed essentially in transverse direction and essentially in the tangential plane between barrel 3 and barrel receiver 6. This recess 111 exhibits a barrel-side part 111' and a receiver-side part 111". In cross section, the recess is essentially rectangularly shaped such that side walls 112' and 113' emerge running parallel to stopping wall 21 of barrel bed 10. Recess 111" in barrel receiver 6 is correspondingly formed and thus exhibits a side wall 113' lying adjacent to stopping face 21 and a further side wall 113". Distance A of side wall 112' in barrel 3 from the plane of stopping face 21 is greater than distance A' of side wall 112". In this recess 111, a wedge 9' is inserted; in the depicted design form, its two, wedge 9 and wedge 9', are provided. The respective recesses 111' and 111" are measured in this such that the distance of their side walls 112', 113' or 112", 113", respectively, is greater from one another than the breadth of wedge 9", or with use of two opposite lying wedges, than the combined width of wedge 9' and 9". By this arrangement, the wedge unit braces itself on the one hand on the side wall 112' of the barrel and on the other on side wall 113"0 of the barrel receiver and thus presses the barrel in the direction of stopping wall 21. The second wedge 9 can be inset in a separate recess of the same construction instead of in a common recess 111, whereby it is advantageous if a wedge effect vertically is also designed, such that a circumferential pressing between barrel and barrel receiver is likewise achieved.

In order to hold the wedge in its tightened position, it is provided that a screw assembly 22 is arranged at its tapered end in the direction of the wedge. The screw assembly supports itself directly or indirectly on barrel receiver 6. The screw assembly consists of a threaded bore hole cut into the wedge and a screw, preferably a washer is provided in addition. With the tension of screw 22', barrel 3 presses itself against stopping face 21 or, respectively, barrel 3 is braced into barrel bed 10 of receiver 6. Washer 22" can support itself in the design with the mutually opposite lying parts 9' and 9", respectively, on the broader face of the neighboring wedge such that an additional wedging effect is achieved.

For securing the wedge-locking mechanism, an additional supplemental locking mechanism 15 can be provided at a distance from the wedge-locking mechanism which essentially by a form fit force effect makes available a securing of the tightening of barrel 3 in reference to breech receiver 6. Concerning this, a pin screw 25 is screwed into a threaded pass-through bore hole 23 in system bearing block 18 and through a bore hole 24 in receiver 6. A recess 26 is formed on the barrel with a pressure surface 27 for the pin screw which protrudes into this recess with its free end and rests form-fit against pressure surface 27.

Figure 7:
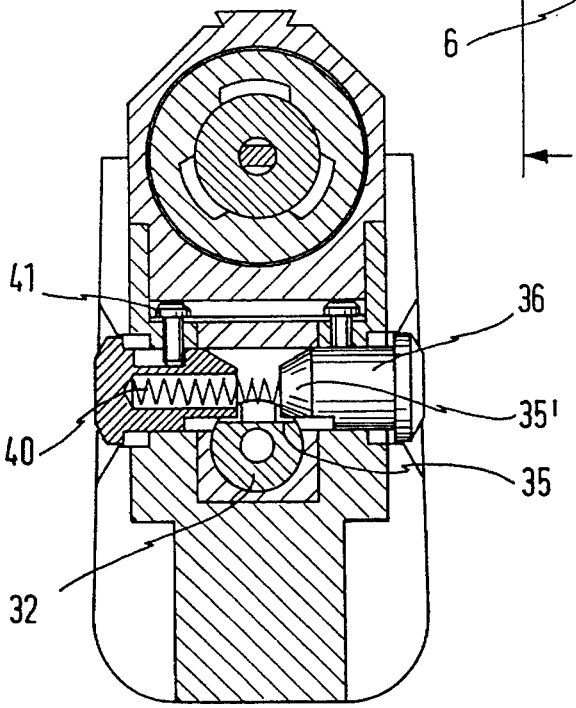
FIG. 7 is a view on a cross section along line E—E in FIG. 1.

Reference will now be made to FIGS. 1 and 7. FIG. 7 shows a view of a section along line E—E in FIG. 1. In system bearing block 18 is formed a chamber 31 for a holding lock 28 for magazine 29.

Holding lock 28 is provided on the side of magazine 29 lying opposite the trigger guard and catches on the face of the magazine. Holding lock 28 exhibits for this purpose a spring-loaded holding pin 32 which possesses a face side engagement catch 33 which meshes into a corresponding cutout 34 in magazine 29. In holding pin 32 is provided in the transverse direction at least one inclined running ramp 35 which works together with a correspondingly wedge-shaped ramp formed on a spring-loaded actuation button 36. With actuation, i.e. pressing in of the actuation button 36, the button ramp is shoved forward and the holding pin is pressed backward by means of the ramp assembly. In the depicted design example are provided two such actuation buttons 36 which press apart from one another by means of a spring 40. Above the actuation buttons 36 are set holding pins 41 in the system bearing block, which mesh with their free end into a slot in the actuation button and limit the path of this actuation button.

Figure 8:
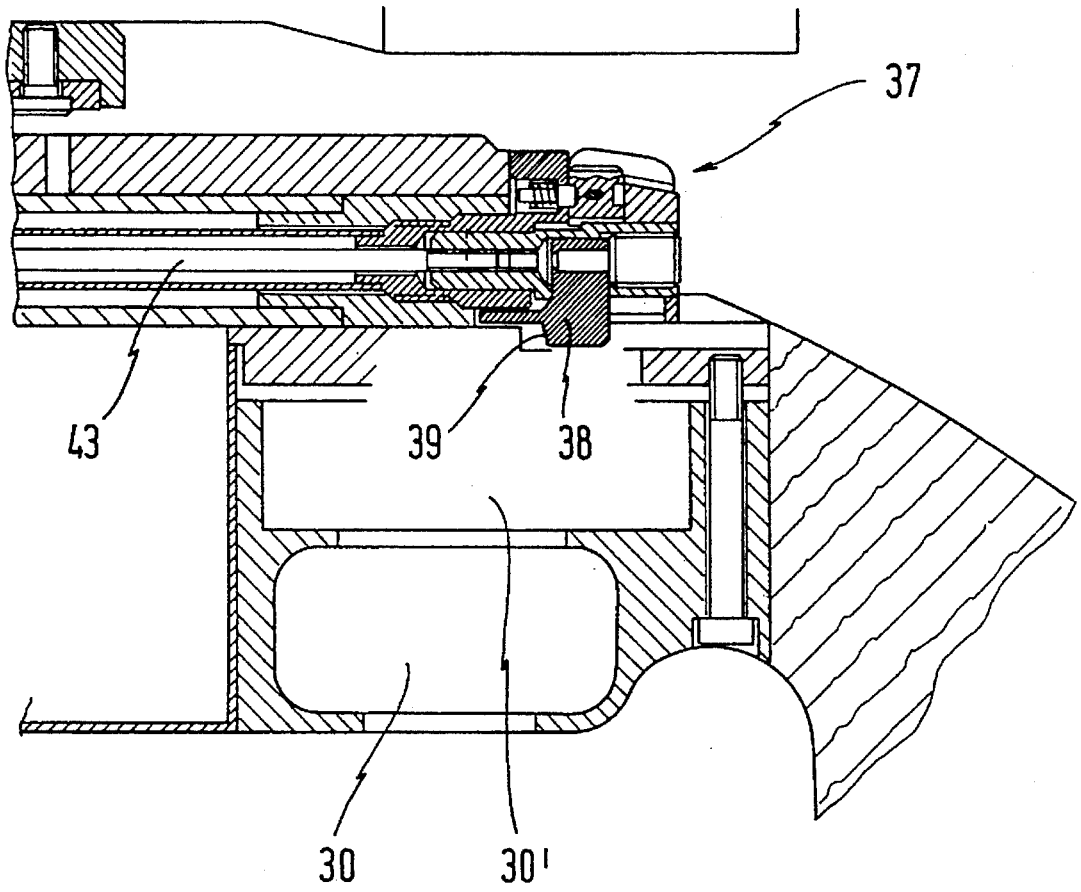
FIG. 8 is a view on a section in longitudinal direction in the area of the trigger with breech bolt.
Figure 9:
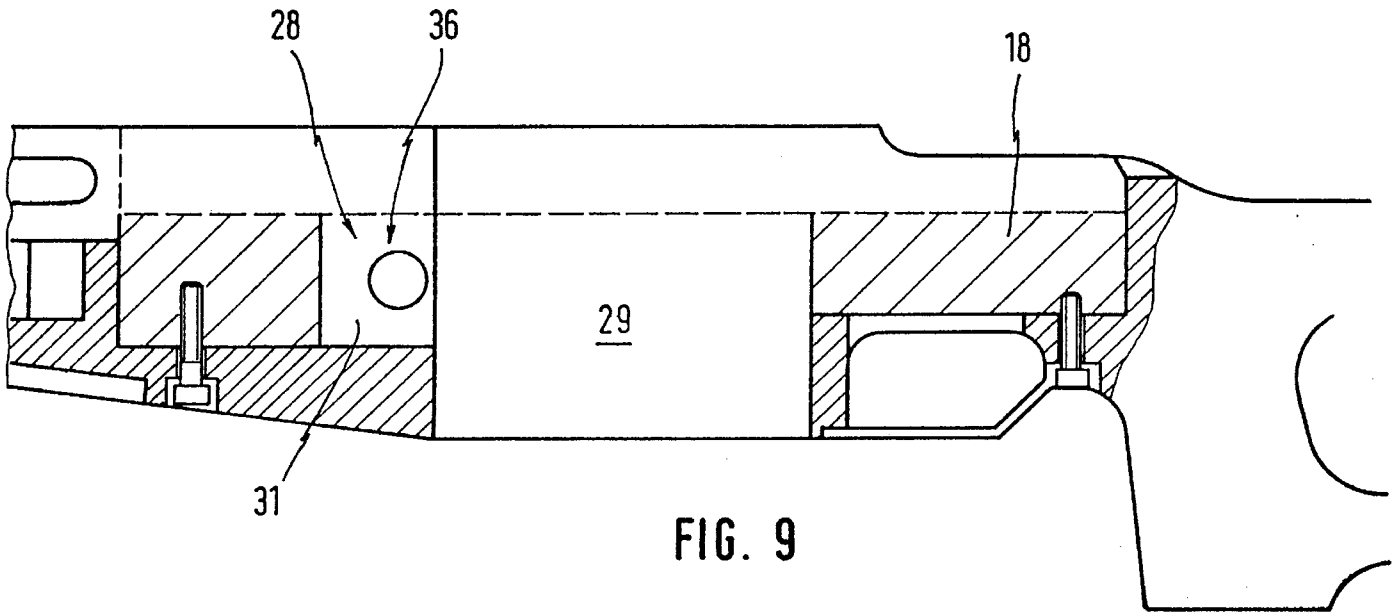
FIG. 9 is a design variant in longitudinal section through the firearm in the area of the system bearing block.

FIG. 8 shows a section depiction of the region of the firearm on which trigger unit 30 with trigger mechanism 30' acts on breech bolt 37. For reasons of comprehensibility, a detailed depiction of trigger mechanism 30' was omitted.

Breech bolt 37 exhibits the customary known elements of a wing safety and is therefore likewise not described in detail. Only elements are mentioned which are essential for the invention. Hence, a firing pin 43 is struck by a firing pin nut 38. Firing pin nut 38 exhibits a pressure surface 39 with which it combines on a corresponding holding piece, for example a buffer (not depicted).

As previously mentioned, it can be necessary that the striking force of the firing pin need be varied among various calibers, which can be accomplished by the pressure surface being displaced forwards or backwards. This can take place according to invention in that one provides firing pin nuts which are equipped and arranged with respectively displaced pressure surfaces.

Figure 10:
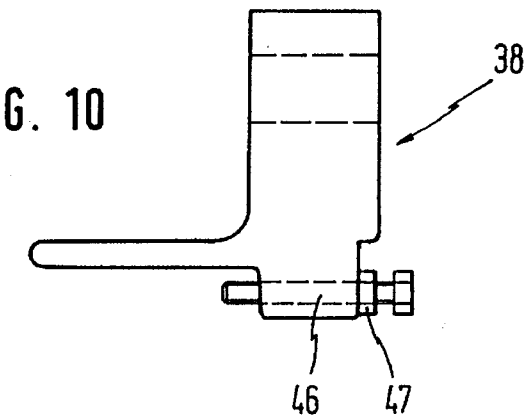
FIG. 10 is a schematic depiction of a firing pin nut with adjusting screw.

In an alternative design in FIG. 10, one such firing pin nut is provided on which the pressure surface on firing pin nut 38 is itself variably held. This can take place through a special design in which the pressure surfaces are formed on the face of an adjustable adjusting screw 46 provided for a corresponding location in a thread in firing pin nut 38. When adjusting screw 46 is turned to the desired position, it can be arrested by means of a counter nut 47.

Figure 11:
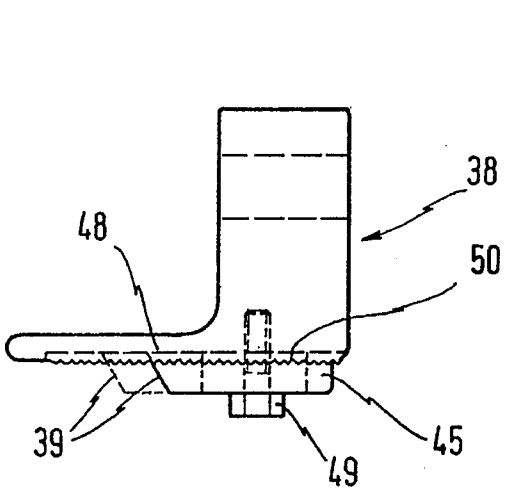
FIG. 11 is a schematic depiction of a firing pin nut with sliding pressure block.

A further design variant in FIG. 11 is observable in that the pressure surface is formed on a pressure sliding block 45. This pressure sliding block is movably held on firing pin nut 38, for example in a track guide 48, and exhibits a grid, e.g. saw tooth 50, whereby a secure positional holding of the pressure sliding lock on the firing pin nut is secured, likewise with a strong spring force of the firing pin spring.

On the surface of pressure sliding block 45 is designed pressure surface 39 which can be equipped with an optimal surface form.

Pressure sliding block 45 is held to firing pin nut 38 with a fixing screw 49 and can be brought to a different position after loosening this screw.

What is claimed is:

1. An improved system bearing on a small arm with an anchoring for a barrel in a barrel bed of a receiver, which works together with a breech block wherein the improvement comprises a barrel clamped in said barrel bed and receiver by means of a wedge-locking system formed by a tension bolt arrangement between said barrel and receiver comprising a rotatable tension bolt in a bore hole running transverse to the barrel direction, the bore hole further comprising a first partial bore formed on the outer diameter of the barrel and a second partial bore in the barrel bed of the receiver, the first partial bore being a cylindrical bore and the second partial bore being a cylindrical bore of different diameter from the first partial bore, the midpoint of the second partial bore being displaced a predetermined distance rearwardly toward the breech block relative to the midpoint of the first partial bore.

2. System bearing according to claim 1, wherein the tension bolt is a cylindrical pin.

3. System bearing according to claim 1, wherein the tension bolt is an eccentrically-shaped pin.

4. System bearing according to claim 1, wherein the midpoints lie in a common plane Z.

5. System bearing according to claim 1, wherein the diameter of the partial boring in the barrel is larger than the diameter of the partial boring in the barrel bed.

6. An improved system bearing on a small arm with an anchoring for a barrel in a barrel bed of a receiver, which works together with a breech block, wherein the improvement comprises a barrel clamped in said barrel bed and receiver by means of a wedge-locking system formed by a tension bolt arrangement between said barrel and receiver, comprising a tension bolt in a bore hole running transverse to the barrel direction, the bore hole being partially in the barrel and partially in the receiver, the tension bolt having a flattened surface section wherein the depth of the flattened surface is greater than the partial diameter of the bore hole in the barrel; further comprising a holding screw passing through said receiver and engageable against said flattened surface of the tension bolt.

7. System bearing according to claim 6, wherein the receiver in the area of the tension bolt arrangement comprises an inset projection which is inserted into an inset recess formed in the system bearing block and is secured by means of a screw.

8. System bearing according to claim 7, wherein the system bearing block comprises in longitudinal section a T-form whereby in the perpendicular bar, are located the receiver for the magazine; in the front part of the crossbar, the wedge-locking mechanism for the barrel; and in the back part of the crossbar the trigger mechanism.

* * * * *